United States Patent [19]

Davidson

[11] 3,940,272

[45] Feb. 24, 1976

[54] METHOD OF DEVELOPING AN ELECTROSTATIC LATENT IMAGE

[75] Inventor: James R. Davidson, Rochester, N.Y.

[73] Assignee: Xerox Corporation, Stamford, Conn.

[22] Filed: Jan. 4, 1974

[21] Appl. No.: 430,868

Related U.S. Application Data

[62] Division of Ser. No. 255,259, May 22, 1972, Pat. No. 3,854,449.

[52] U.S. Cl. ..... 96/1.4; 96/15 D; 96/1.2; 427/18; 427/21

[51] Int. Cl.[2] G03G 15/01; G03G 15/08; G03G 15/09

[58] Field of Search..... 96/15 D, 1.4, 1.2; 117/17.5; 118/637; 355/3 DD; 427/18, 21

[56] References Cited

UNITED STATES PATENTS

| | | | |
|---|---|---|---|
| 3,609,029 | 9/1971 | Egnaczak | 355/3 |
| 3,671,119 | 6/1972 | Engel et al. | 355/3 |
| 3,712,266 | 1/1973 | Stauffer | 118/636 |
| 3,721,209 | 3/1973 | Szostak et al. | 118/2 |

*Primary Examiner*—David Klein
*Assistant Examiner*—John R. Miller
*Attorney, Agent, or Firm*—H. Fleischer; J. J. Ralabate; C. A. Gron

[57] ABSTRACT

An apparatus for developing an electrostatic latent image. The apparatus is moved from an inoperative position spaced from the latent image to a position in operative communication therewith. After the latent image is developed, the apparatus is moved to the inoperative position thereof.

3 Claims, 3 Drawing Figures

METHOD OF DEVELOPING AN ELECTROSTATIC LATENT IMAGE

This is a division of application Ser. No. 255,259, filed May 22, 1972, now U.S. Pat. No. 3,854,449.

BACKGROUND OF THE INVENTION

This invention relates generally to an electrostatographic printing machine, and more particularly concerns an improved development system for use therein.

An electrostatographic process involves the formation and utilization of electrostatic latent charge patterns for the purpose of recording and reproducing the patterns in viewable form. The field of electrostatography includes electrophotography and electrography. Electrophotography is that class of electrostatography which employs a photosensitive medium to form, with the aid of electromagnetic radiation, the electrostatic latent charge pattern. Xerography, which employs infrared, visible or ultraviolet radiation, and xeroradiography, which employs x-rays or gamma rays, are subclasses of electrophotography. Electrography is that class of electrostatography which utilizes an insulating medium to form, without the aid of electromagnetic radiation, the electrostatic latent charge pattern. Xero printing, which uses a pattern of insulating material on a conductive medium to form electrostatic charge patterns, and electrographic recording, which uses a charge transfer between a plurality of electrodes to form directly, electrostatic charge patterns, are subclasses of electrography. Development, which is the act of rendering an electrostatic pattern or image viewable, is employed in all of the aforementioned classes of electrostatography. In the illustrated embodiment hereinafter discussed, an electrophotographic process is utilized.

An electrophotographic process involves the use of a photosensitive element having a photoconductive insulating layer which is charged to a substantially uniform potential in order to sensitize its surface. The charged photoconductive surface is exposed to a light image of an original document to be reproduced. As a consequence of the exposure, the charge is selectively dissipated in the irradiated areas in accordance with the light intensity reaching the surface, thereby creating an electrostatic latent image on the photoconductive surface. Development of the electrostatic latent image recorded on the photoconductive surface is achieved by bringing the charged photoconductive surface into contact with a developer mix. Typical developer mixes employed are well-known in the art, and generally comprise dyed or colored thermoplastic powders, known in the art as toner particles, which are mixed with coarser carrier granules, such as ferromagnetic granules. The toner particles and carrier granules are selected such that the toner particles acquire the appropriate charge relative to the electrostatic latent image recorded on the photoconductive surface. When the developer mix is brought into contact with the charged photoconductive surface, the greater attractive force of the latent electrostatic image recorded thereon causes the toner particles to transfer from the carrier granules and adhere to the latent electrostatic image. This concept was originally disclosed by Carlson in U.S. Pat. No. 2,297,691 and is further amplified and described by many related patents in the art.

Many factors influence the quality of the developed image, the most significant factor being the uniformity with which the toner particles are deposited on the electrostatic latent image recorded on the photoconductive surface. Heretofore, development systems have employed rotary impellers, fur brushes, bucket conveyors and magnetic brush systems to achieve the requisite uniformity in toner deposition. The magnetic brush system achieves a high degree of uniform toner deposition, and, therefore, numerous electrostatographic printing machines utilize this type of development system. Magnetic brush systems usually include a developer roll having a directional flux field adapted to bring the magnetizable developer mix into contact with the charged photoconductive surface. Multicolor electrostatographic printing involves the utilization of various processing components adapted to produce a series of electrostatic latent images corresponding to a particular color of the original. In such a system, there is a need to develop successive partial color images. Each partial color image is developed with toner particles corresponding in color to the partial color image utilized to form the respective electrostatic latent image on the photoconductive surface.

Generally, the developer roll of the magnetic brush development system is mounted fixedly relative to the photoconductive surface. This places a practical limitation on the quality of multi-color copies. A multi-color development system utilizes a plurality of developer rolls, each being adapted to furnish the appropriate colored toner particles to the photoconductive surface. Hereinbefore, fixedly mounted developer rolls were closely spaced to the photoconductive surface, thereby permitting the operative developer roll, i.e. the developer roll having the developer mix adhering thereto. However, when a developer mix having toner particles of one color contacts a toner powder image of another color, intermingling of colors and mechanical scraping occurs. This results in the toner powder image being mis-colored, and the multi-color copy produced thereby lacking the appropriate color balance, i.e. the color does not correspond to the original to be copied. Therefore, it is apparent that the aforementioned type of magnetic brush development system, wherein each developer roll is fixedly mounted, does not produce high quality multi-color copies.

Accordingly, it is a primary object of the present invention to improve the development system of a multi-color electrostatographic printing machine.

SUMMARY OF THE INVENTION

Briefly stated and in accordance with the present invention, there is provided an apparatus for rendering visible a latent electrostatic image. The apparatus is positioned adjacent the latent image in operative communication therewith for depositing toner particles thereon. In addition, the apparatus moves from the operative position in communication with the latent image to an inoperative position spaced therefrom.

The present invention is also concerned with actuating the development apparatus in response to the electrostatic latent image advancing to a pre-determined location. The apparatus is energized when the latent image reaches the predetermined location to move to a position adjacent thereto in operative communication therewith, and deposits toner particles thereon. After the toner particles are deposited onto the latent image, the apparatus is de-energized and moved to its inoperative position spaced from the latent image.

BRIEF DESCRIPTION OF THE DRAWINGS

Other objects and advantages of the present invention will become apparent upon reading the following detailed description and upon reference to the drawings in which.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
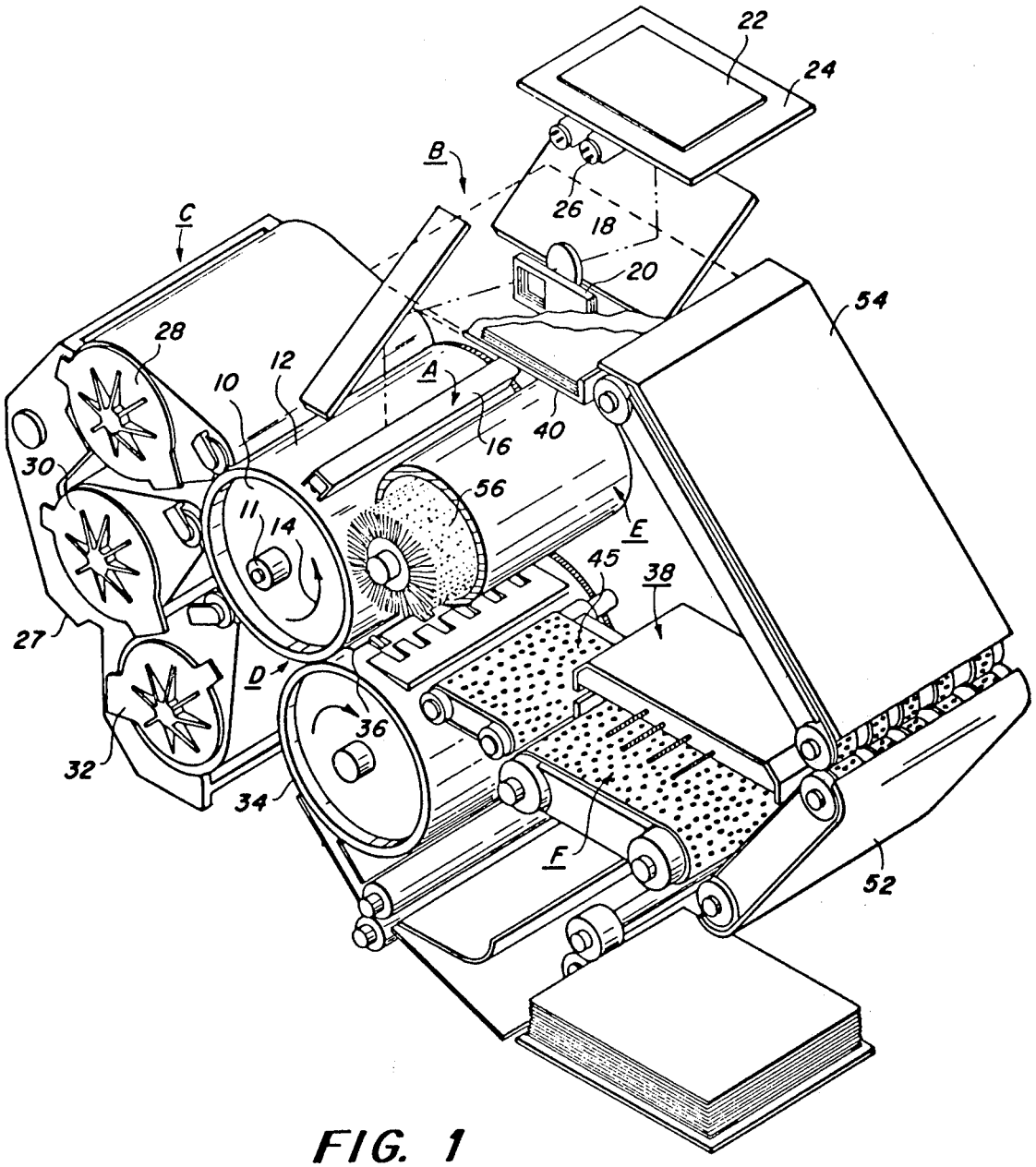
FIG. 1 is a schematic perspective view of an electrographic printing machine embodying the features of the present invention.

For a general understanding of the illustrated electrophotographic printing machine, in which the present invention may be incorporated, reference is had to the drawings wherein like reference numerals have been used throughout to designate like elements. FIG. 1 schematically illustrates the various components of a printing machine producing multicolor copies from a color original. As in all electrophotographic machines of the type illustrated, a light image of a document to be reproduced is projected onto a sensitized photoconductive surface to form an electrostatic latent image thereon. The latent image is developed by toner particles to form a powder image of the latent image recorded on the photoconductive surface. Thereafter, the powder image is electrostatically transferred to a sheet of support material to which it may be coalesced by a suitable fusing device, whereby the powder image is caused permanently to adhere to the support surface.

The printing machine depicted in FIG. 1 employs a photoconductive member, such as rotatably mounted drum 10, having a photoconductive surface 12 thereon. Photoconductive surface 12, preferably, is formed of a material having a relatively panchromatic response to white light. Drum 10 rotates in the direction indicated by arrow 14 to move photoconductive surface 12 sequentially through a series of processing stations.

First, photoconductive surface 12 passes through charging station A which has positioned thereat a corona generating device, indicated generally at 16, extending transversely across photoconductive surface 12. Corona generating device 16 charges drum surface 12 to a relatively high and substantially uniform potential.

The charged drum surface is next rotated to exposure station B which includes a moving lens system, generally designated by the reference numeral 18, and a color filter mechanism, shown generally at 20. An original document 22 is stationarily supported upon a transparent viewing platen 24 wherein successive incremental areas of original 22 are illuminated by means of a moving lamp assembly 26. Lens system 18 is adapted to scan successive areas of original 22 being illuminated on platen 24 and to focus the light onto photoconductive surface 12. Lamp assembly 26 and lens system 18 are moved in timed relation with photoconductive surface 12 to produce a non-distorted flowing light image of the original on photoconductive surface 12. During exposure, filter mechanism 20 interposes selected color filters into the optical light path of lens 18. Color filters 20 operate on the light passing through lens 18 to record an electrostatic latent image on photoconductive surface 12 corresponding to a specific color of the flowing light image of the original.

After the electrostatic latent image is recorded on photoconductive surface 12, drum 10 is rotated to development station C which includes three individual development units generally indicated by the reference numerals 28, 30 and 32, respectively. The development units are all of a type hereinbefore referred to as a magnetic brush development system. In a magnetic brush development system, a magnetizable developer mix having carrier granules and toner particles is continually brought through a directional flux field to form a brush of developer material. The developer mix is continually moving to provide fresh developer mix to the brush. Preferably, the brush in the magnetic brush system comprises a magnetic member with a mass of developer mix adhered thereto by magnetic attraction. The developer mix includes carrier granules having toner particles clinging thereto by triboelectric attraction. This chainlike arrangement of developer mix simulates the fibers of a brush. Development is achieved by bringing the brush of developer mix into contact with photoconductive surface 12. Each of the development units 28, 30 and 32, respectively, apply toner particles to photoconductive surface 12 which are adapted to absorb light within a pre-selected spectral region of the electromagnetic wave spectrum corresponding to the wavelength of light transmitted through the filter. For example, a latent image formed by passing the light image through a green filter will record the red and blue portions of the spectrum as areas of relatively high charge density on photoconductive surface 12, while the green light rays will pass through the filter and cause the charge density on photoconductive surface 12 to be reduced to a voltage level ineffective for development. The charged areas are then made visible by applying green absorbing (magenta) toner particles to the latent image recorded on photoconductive surface 12. Similarly a blue separation is developed with blue absorbing (yellow) toner particles, while a red separation is developed with red absorbing (cyan) toner particles.

After development, the now visible image is moved to transfer station D where the image is transferred to a sheet of final support material 36, such as plain paper amongst others, by means of a transfer member, i.e. a bias transfer roll shown generally at 34. The surface of transfer roll 34 is electrically biased to a potential having a magnitude and polarity sufficient to electrostatically attract toner particles from photoconductive surface 12 to support sheet 36. Transfer roll 34 is adapted to secure releasably thereto a single sheet of final support material 36 for movement in a recirculating path, the roll being arranged to move in synchronism with photoconductive surface 12 enabling support material 36 to receive, in superimposed registration, successive toner powder images of the original document. The aforementioned steps of charging the photoconductive surface, exposing the photoconductive surface to a specific color of the flowing light image of the original, developing the electrostatic latent image recorded on the photoconductive surface with appropriate toner particles, and transferring the toner powder image to a sheet of final support material, e.g. a transparency or opaque copy sheet, are repeated a plurality of cycles to form a multi-color copy of a color original.

After the last transfer operation, support sheet 36 is stripped from roll 34 and transported on endless belt 49 to a fixing station F where a fuser, indicated generally at 38, coalesces the toner powder image to support sheet 36. Thereafter, sheet 36 is advanced by endless belts 52 and 54 to catch tray 40 for subsequent removal by an operator.

The last processing station in the direction of rotation of drum 10, as indicated by arrow 14, is cleaning station E. A rotatably mounted fibrous brush 56 is positioned in cleaning station E and is maintained in contact with photoconductive surface 12 of rotating drum 10 to remove residual toner particles remaining thereon after each transfer operation.

Figure 2:
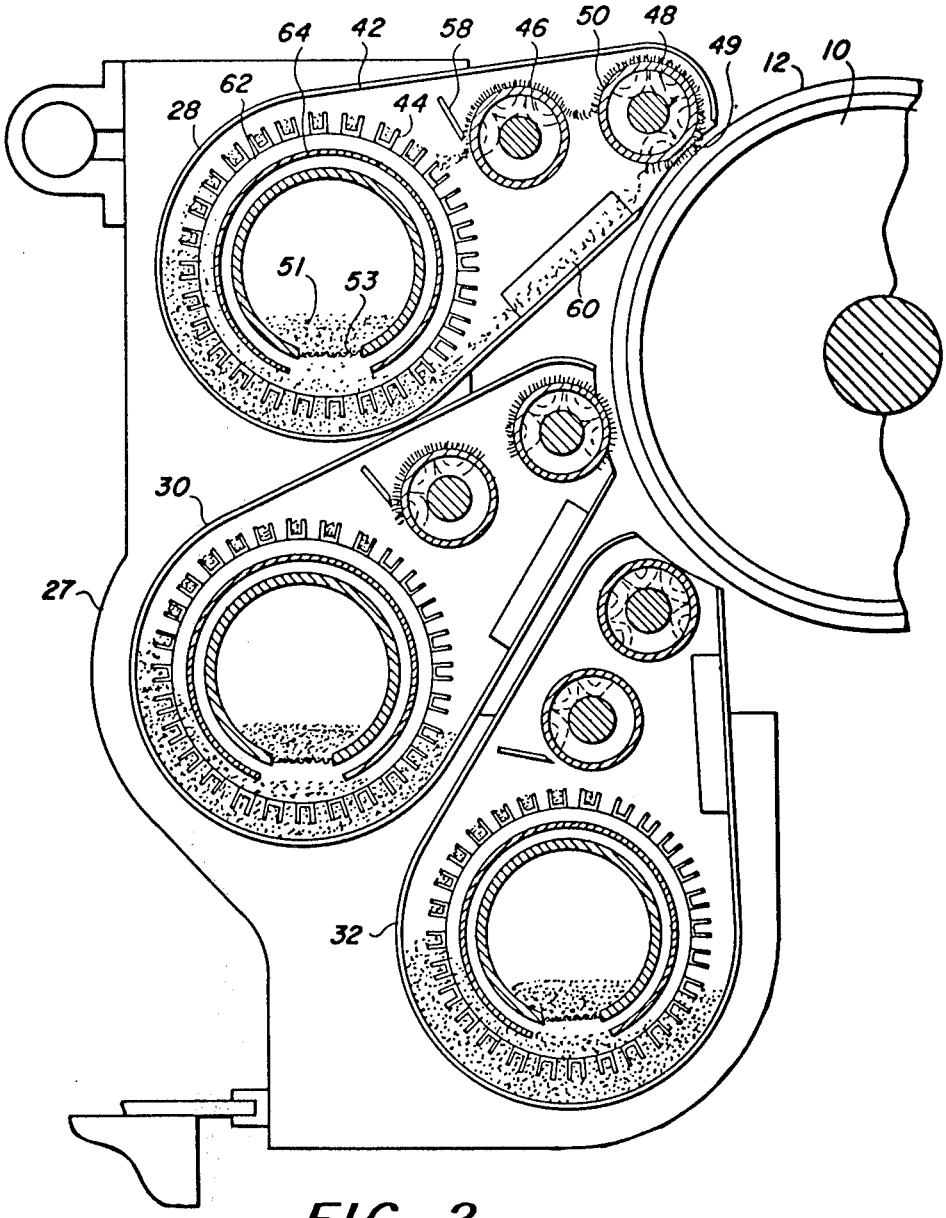
FIG. 2 is a sectional elevational view of the development system of the present invention used in the printing machine illustrated in FIG. 1.

Referring now to FIG. 2, there is shown a multicolor development system with frame 27 supporting three toner depositing means or development units 28, 30 and 32, respectively. The aforementioned development system is of the type utilized at processing station C. These development units are depicted in an elevational sectional view to indicate more clearly the various components included therein. Only development unit 28 will be described in detail as development units 30 and 32 are nearly identical thereto, the distinction between each developer unit being the color of toner particles contained therein and minor geometrical differences due to the mounting cycle. Developer unit 28 may have yellow toner particles, unit 30 magenta toner particles, and unit 32 cyan toner particles although different color combinations may be used. For purposes of explanation, development unit 28 will be hereinafter described in detail.

The principle components of developer unit 28 are a developer housing 42, conveyor means or paddle wheel 44, transport means or roll 46, and developer means or roll 48. Paddle wheel 44 is a cylindrical member with buckets or scoops around the periphery thereof and is adapted to rotate so as to elevate developer mix 50 from the lower region of housing 42 to the upper region thereof. When developer mix 50 reaches the upper region of housing 42, it is lifted from the paddle wheel buckets to transport roll 46. Alternate buckets of the paddle wheel have apertures in the root diameter so that developer mix carried in these areas is not carried to transport roll 46 but instead, falls back to the lower region of developer housing 42. As the developer mix falls back to the lower region of developer housing 42, it cascades over shroud 62 which is of a tubular configuration with an aperture 53 in the lower region thereof. Developer mix 50 is recirculated in this manner so that the carrier granules are continually agitated to mix with fresh toner particles. This generates a strong triboelectric charge between the carrier granules and toner particles. As developer mix 50, in the paddle wheel buckets, approaches transport roll 46, the magnetic fields produced by the fixed magnets therein attract developer mix 50. Transport roll 46 moves developer mix 50 in an upwardly direction by the frictional force exerted between the roll surface and developer mix. A surplus of developer mix 50 is furnished, and metering blade 58 is provided to control the amount of developer mix 50 carried over the top of transport roll 46. The surplus developer mix 50 is sheared from transport roll 46 and falls in a downwardly direction toward paddle wheel 44. As the surplus developer mix descends, it falls through the apertures of paddle wheel 44 in a downwardly direction into the lower region of developer housing 42.

The developer mix which passes metering blade 58 is carried over transport roll 46 to developer roll 48 and into development zone 49 located between photoconductive surface 12 and developer roll 48. The electrostatic image recorded on the photoconductive surface is developed by contact with the moving developer mix 50. The charged areas of photoconductive surface 12 electrostatically attract the toner particles from the carrier granules of developer mix 50. At the exit of development zone 49, the strong magnetic fields in a direction generally tangential to developer roll 48 continues to secure thereto the unused developer mix and denuded carrier granules. Upon passing from the development zone, the unused developer mix and denuded carrier granules enter a region relatively free from magnetic forces and fall from developer roll 48 in a downwardly direction into the lower region of developer housing 42. As the unused developer mix and denuded carrier granules descend, they pass through mixing baffle 60 which diverts the flow from the ends towards the center of developer housing 42 to provide mixing in this direction.

When the complete image recorded on photoconductive surface 12 has passed development zone 49, the development action must be discontinued and the developer mix removed from contact with the photoconductive drum 10 so that it will not effect subsequent images which are to be developed in different colors. To do this, a suitable drive motor (not shown) is disconnected from paddle wheel 44, transport roll 46 and developer roll 48 stopping their rotation. This permits developer housing 28 to pivot due to the force of spring 68, to the non-operative position thereof in which developer roll 48 is spaced from the latent image recorded on photoconductive surface 12.

Cylindrical shroud 62 serves to control the fall of the unused developer mix and denuded carrier granules such that they mix with the toner particles rather than simply falling into the lower region of developer housing 42. Furthermore, shroud 62 isolates, from the developer mix, an interior cylindrical enclosure which is used to house cylindrical toner dispenser 64. Toner dispenser 64 contains a fresh supply of toner 51 which is dropped through aperture 53 in the shroud into the stream of developer mix 50. Adding toner particles at this location ensures that it cannot be carried into development zone 49 without some degree of mixing with the carrier granules. Additional toner particles are added to the developer mix in order to replace the toner particles used in forming powder images, thereby maintaining the concentration thereof substantially constant, providing uniform color image developability.

Figure 3:
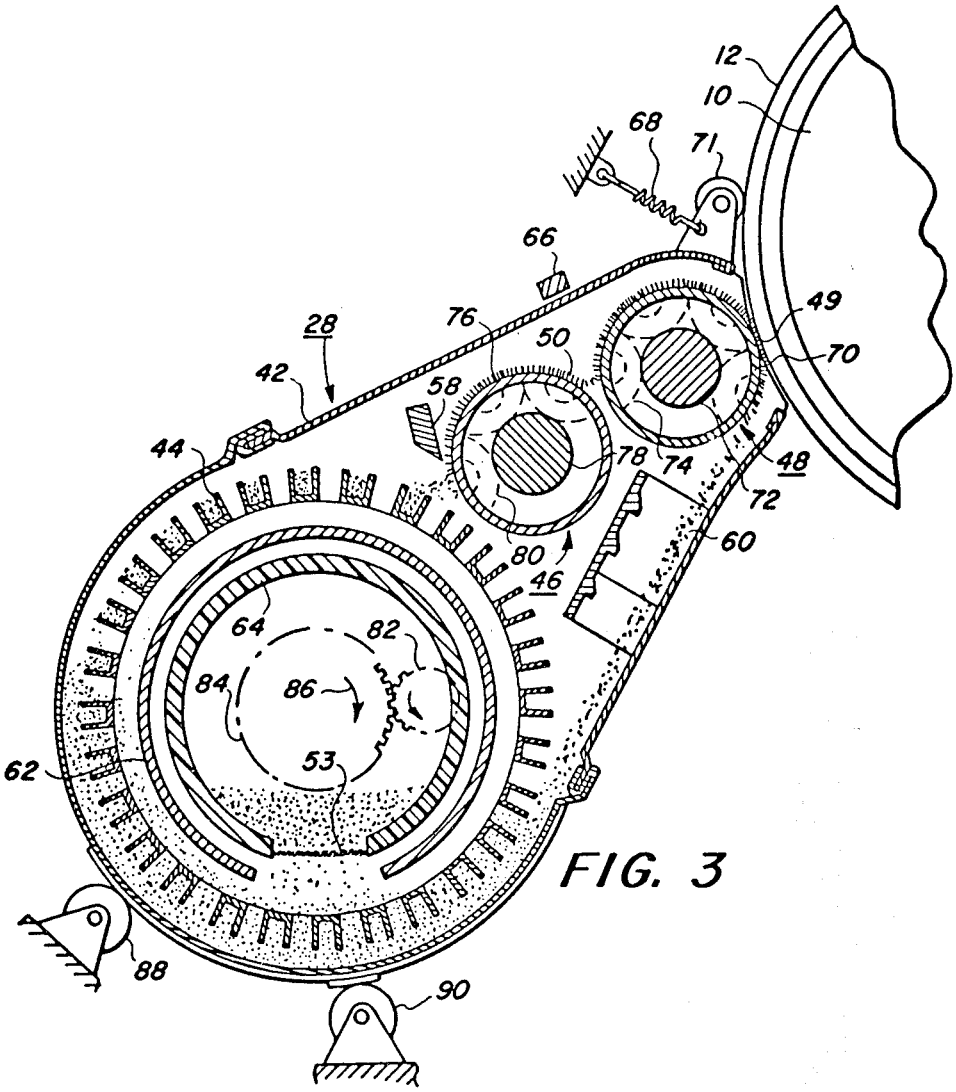
FIG. 3 is a fragmentary sectional elevational view depicting, in detail, one of the development units shown in FIG. 2.

Turning now to FIG. 3, the operative procedure of developer unit 28 will be discussed in detail. Developer housing 42 is pivoted, as described hereinafter, about the center of paddle wheel 44 and is supported at the lower region of the exterior surface by rollers 88 and 90 mounted rotatably in frame 27. Rollers 88 and 90 rotate about their respective axes to permit developer housing 42 to pivot substantially about the center of paddle wheel 44. When development unit 28 is inoperative, biasing means or spring 68 pivots developer housing 42 against stop 66. In this position, developer roll 48 is in its non-operative position spaced from photoconductive surface 12. Operation begins when clutch gear 82 meshes with gear 84 which is attached to paddle wheel 44, thereby causing paddle wheel 44 to revolve clockwise as indicated by arrow 86. As gear 84 and paddle wheel 44 start to rotate, a reaction torque is exerted against developer housing 42 due to the resistance to motion of developer mix 50 which fills developer housing 42. The reaction torque causes housing 42 to rotate clockwise against the force of spring 68 until a stop, shown as wheel 70, is positioned against drum 10. The developer mix and internal parts then move within developer housing 42. Rolls 46 and 48 are rotated in conjunction with paddle wheel 44 by a gear train (not shown). When the complete image of photoconductive drum 10 has passed development zone 49, development action is discontinued and the developer mix removed from contact with photoconductive surface 12 to prevent its effecting subsequent images which are to be developed by different colored toner particles. To achieve this, the drive motor is disconnected from gear 82 by deenergizing the clutch leaving gear 82 free to turn in either direction. Paddle-wheel 44, developer roll 48, and transport roll 46 stop rotating, and developer housing 42 is pivoted clockwise by spring 68 until it engages stop 66 at its inoperative position. This completes the cycle.

The aforementioned procedure has been described for development unit 28, however, this procedure is repeated for development units 30 and 32, respectively. In the formation of a multi-color copy, development unit 28 initially positions developer roll 48 adjacent photoconductive surface 12 in operative communication therewith to develop the first partial color latent electrostatic image formed thereon with the appropriately colored toner particles. Thereafter, the toner particles are transferred to support material 36 (FIG. 1) forming a toner powder image of one color of the multi-color original. Subsequently, development unit 32 positions its respective developer roll adjacent photoconductive surface 12 in operative communication therewith to develop the next successive colored image which, in turn, is transferred to support material 36. Thereafter, development unit 30 is positioned adjacent photoconductive surface 12 in operative communication therewith to develop the next successive colored image. This toner powder image is also transferred to support material 36 forming a composite multi-color toner powder image of the original on the support material which is thereafter coalesced in fuser 38 (FIG. 1).

In the preferred embodiment thereof, developer means or roll 48, best shown in FIG. 3, includes a non-magnetic tubular member 70, preferably made from aluminum having an irregular or roughened exterior surface. Tubular member 70 is journaled for rotation by suitable means such as ball bearing mounts. A shaft 72 made preferably of steel is concentrically mounted within tubular member 70 and serves as a fixed mounting for magnetic means 74. Magnetic means 74, preferably, comprises magnets made of barrium ferrite in the form of annular rings and arranged with five poles on about a 284° arc about shaft 72.

As best shown in FIG. 3, transport means or roll 46 includes a non-magnetic tubular member 76, preferably, made from aluminum having an irregular or roughened exterior surface. Tubular member 76 is journaled for rotation by suitable means such as ball bearing mounts. A shaft 78 made, preferably, of steel is concentrically mounted within tubular member 76 and functions as a fixed mounting for magnetic means 80. Magnetic means 80, preferably, includes barrium ferrite magnets in the form of annular rings arranged with four poles on a 180° arc about shaft 78.

The means for actuating each of the toner depositing means or development units 28, 30 and 32, respectively, is a timing disc mounted to an extension of drum shaft 11 (FIG. 1). The timing disc is opaque with a plurality of spaced slots in the circumferential periphery thereof. The timing disc is interposed between an illuminating source and a photosensor to generate an electrical signal as each slot permits light rays to pass through the disc. The electrical signal, in association with a suitable machine logic control system, activates the appropriate development unit. Activation of the development unit energizes the drive motor which rotates the paddle wheel, transport roll and developer roll producing a reaction torque which overcomes the spring restraining force, wherein the developer roll is moved into operative communication with the photoconductive surface. After the photoconductive surface has rotated through an appropriate angle, a slot in the timing disc permits the light rays from the illumination source to once again cause the photosensor to generate a second electric signal, which, in association with the machine control logic, de-activates the development unit by de-energizing the driving motor. Inactivation of the development unit automatically causes the development unit to be moved to the inoperative position, wherein the developer roll is spaced from the photoconductive surface.

While the invention has been described in connection with a magnetic brush development system, one skilled in the art will appreciate that the invention is not necessarily so limited and that fur brush development may also be utilized. In fur brush development, brush fibers replace carrier granules, and when the brush is saturated with toner particles the toner particles become charged triboelectrically. A soft fur is used in the form of a cylindrical brush. Toner particles are fed continuously to the brush and when activated moves from its inoperative position spaced from the photoconductive surface to its operative position in communication therewith.

From the foregoing, it is apparent that developing system of the present invention improves multi-color copies produced on an electrostatic printing machine by maintaining inoperative development units spaced from the photoconductive surface. Furthermore, the development system is designed to move the appropriate development unit into operative communication with the photoconductive surface for transferring thereto appropriately colored toner particles to render visible the electrostatic latent image recorded thereon.

It is, therefore, evident that there has been provided in accordance with this invention, an apparatus and method for developing an electrostatic latent image that fully satisfies the objects, aims and advantages set forth above. While this invention has been described in conjunction with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. A method of rendering visible an electrostatic latent image, including the steps of:

activating a drive system for moving an assembly which transports developer mix to a developer roll being rotated by the drive system, whereby the reaction torque produced by the drive system pivots a developer housing having the transport assembly and developer roll located therein to dispose the developer roll adjacent the latent image in operative communication therewith;

attracting toner particles from the developer roll to the latent image;

de-activating the drive system to substantially remove the reaction torque being applied to the developer housing; and resiliently urging the developer housing to pivot disposing the developer roll in an inoperative position spaced from the latent image.

2. A method of printing including the steps of:

charging a photoconductive surface to a substantially uniform potential;

exposing the charged photoconductive surface to a flowing light image of an original to be copied recording a latent image thereon;

activating a drive system for moving an assembly which transports developer mix to a developer roll being rotated by the drive system, whereby the reaction torque produced by the drive system pivots a developer housing having the transport assembly and developer roll located therein to dispose the developer roll adjacent the photoconductive surface in operative communication therewith;

attracting toner particles from the developer roll to the latent image;

de-activating the drive system to substantially remove the reaction torque being applied to the developer housing; and resiliently urging the developer housing to pivot disposing the developer roll in an inoperative position spaced from the photoconductive surface.

3. A method of printing as recited in claim 1, further including the steps of:

transferring toner particles from the latent image to a sheet of support material; and fixing the toner particles permanently to the sheet of support material.

* * * * *